US006447330B1

(12) United States Patent
Neiser

(10) Patent No.: US 6,447,330 B1
(45) Date of Patent: Sep. 10, 2002

(54) CORD-REEL ASSEMBLY PARTIALLY MOUNTED WITHIN A WALL

(76) Inventor: Gabe Neiser, 2106 Nicole Dr., Port Jefferson Station, NY (US) 11776

( * ) Notice: Subject to any disclaimer, the term of this patent is extended or adjusted under 35 U.S.C. 154(b) by 0 days.

(21) Appl. No.: 09/799,647

(22) Filed: Mar. 5, 2001

(51) Int. Cl.[7] ..... H01R 13/72
(52) U.S. Cl. ..... 439/507; 191/12.2 R; 439/540.1
(58) Field of Search ..... 439/501, 540.1; 191/12.4, 12.2 R

(56) References Cited

U.S. PATENT DOCUMENTS

| | | | | |
|---|---|---|---|---|
| 4,114,736 A | | 9/1978 | Scherenberg | 191/12.4 |
| 4,384,688 A | * | 5/1983 | Smith | 191/12.2 R |
| 4,725,697 A | | 2/1988 | Kovacik et al. | 191/12.4 |
| 5,114,365 A | * | 5/1992 | Thompson et al. | 439/540.1 |
| 5,236,371 A | | 8/1993 | Matthis | 439/501 |
| 5,562,488 A | | 10/1996 | Neiser et al. | 439/501 |
| 5,700,158 A | | 12/1997 | Neiser et al. | 439/501 |

* cited by examiner

*Primary Examiner*—Tulsidas Patel
(74) *Attorney, Agent, or Firm*—Keusey, Tutunjian & Bitetto, P.C.

(57) ABSTRACT

A cord-reel assembly having an in-wall assembly connected to a source of electricity and including an electrical power receptacle. A cover plate having a decorative side and an engagement side is provided for connection to the in-wall assembly. The cover plate includes at least one stationary outlet receptacle, an internal cord-reel and at least one outlet receptacle connected to the end of the internal cord-reel and being accessible from said decorative side of said cover plate. A plug on the engagement side of the cover plate is adapted to align with and engage the electrical power receptacle in the in-wall assembly and thereby provide power to the cord-reel and stationary outlet receptacles.

19 Claims, 6 Drawing Sheets

CORD-REEL ASSEMBLY PARTIALLY MOUNTED WITHIN A WALL

BACKGROUND OF THE INVENTION

1. Field of the Invention

The invention relates to wall mounted cord-reel assemblies. More particularly, it relates to a cord-reel assembly that is partially mounted in the wall and includes a wall cover plate that is electrically connected to the in-wall box and includes the cord reel.

2. Description of the Prior Art

The concept of an in-wall cord reel assembly is shown in U.S. Pat. No. 5,700,158. The '158 patent shows the implementation of box mounted in the wall for accommodating the cord-reel and the hardwiring of the electrical supply to the device. A cover plate is electrically attached to the in wall housing and an adjacently mounted outlet using plugs. The cover plate electrically connects the existing outlet to the internally mounted cord-reel in order to provide power to the reel.

U.S. Pat. No. 5,562,488 discloses a modular outlet assembly that provides a cord-reel contained within a housing that is adapted to replace the cover plate of an ordinary outlet. This is an accessory item that basically converts a standard outlet into a plurality of outlets, including a short extension cord operably disposed within the housing.

SUMMARY OF THE INVENTION

It is therefore an object of the invention to provide a cord-reel assembly for using in new construction and existing construction environments.

It is yet another object of the invention to provide a cord-reel assembly that combines the advantageous features of an exteriorly mounted cord-reel assembly with the integrity of an in-wall mounting of cord-reel assemblies.

These and other objects are achieved in accordance with an embodiment of the invention wherein an in-wall assembly is connected to a source of electricity and includes an electrical power receptacle, and a cover plate having a decorative side and an engagement side is provided for connection to the in-wall assembly. The cover plate includes at least one stationary outlet receptacle, an internal cord-reel and at least one outlet receptacle connected to the end of the internal cord-reel and being accessible from said decorative side of said cover plate. A plug on the engagement side of the cover plates is adapted to align with and engage the electrical power receptacle in the in-wall assembly and thereby provide power to the cord-reel and the at least one stationary outlet receptacle.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numeral denote similar components throughout the views.

DETAILED DESCRIPTION OF PREFERRED EMBODIMENTS

Figure 1A:
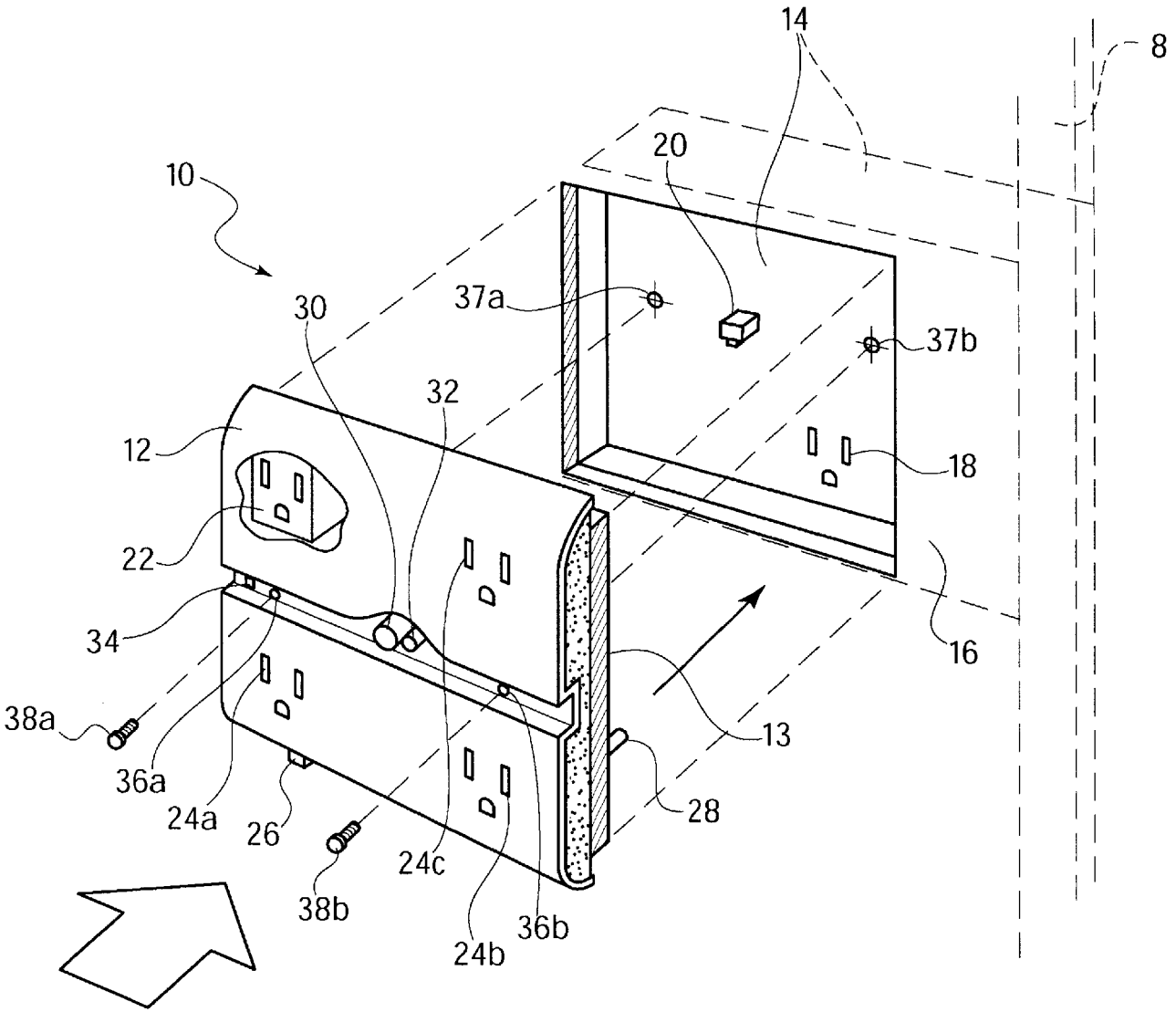
FIG. 1*a* is a perspective view of the cord-reel assembly according to an embodiment of the invention.
Figure 6B:
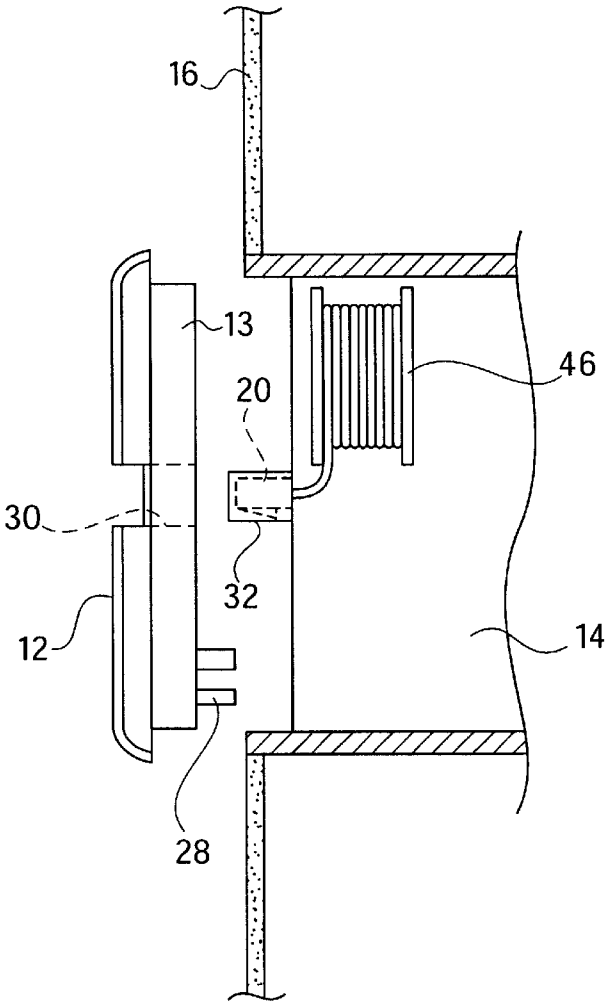
FIG. 6*b* is a partial cross-sectional view of the cord-reel assembly according to another embodiment of the invention.

Referring to FIGS. 1*a,* 1*b,* 6*a* and 6*b* there are shown some different embodiments of the cord-reel assembly 10 according to the invention. Cord-reel assembly 10 is made up of an in wall box 14 and an outer cover plate 12. In-wall box 14 is preferably mounted between wall studs 8 with mounting brackets (not shown) attached to the studs 8, but may also be mounted using other known drywall methods in an existing construction environment (e.g., madison clips, etc.). In-wall box 14 is recessed from the wall 16 by a predetermined amount and is hard wired to the electrical supply of the building. In addition, the in-wall box can include a telephone cord reel 46 (FIG. 6*b*) and a modular telephone plug 20 that is extendable through hole 30 in cover plate 12. In this embodiment, in-wall box 14 is also hard wired to the telephone line or lines of the building.

Figure 2:
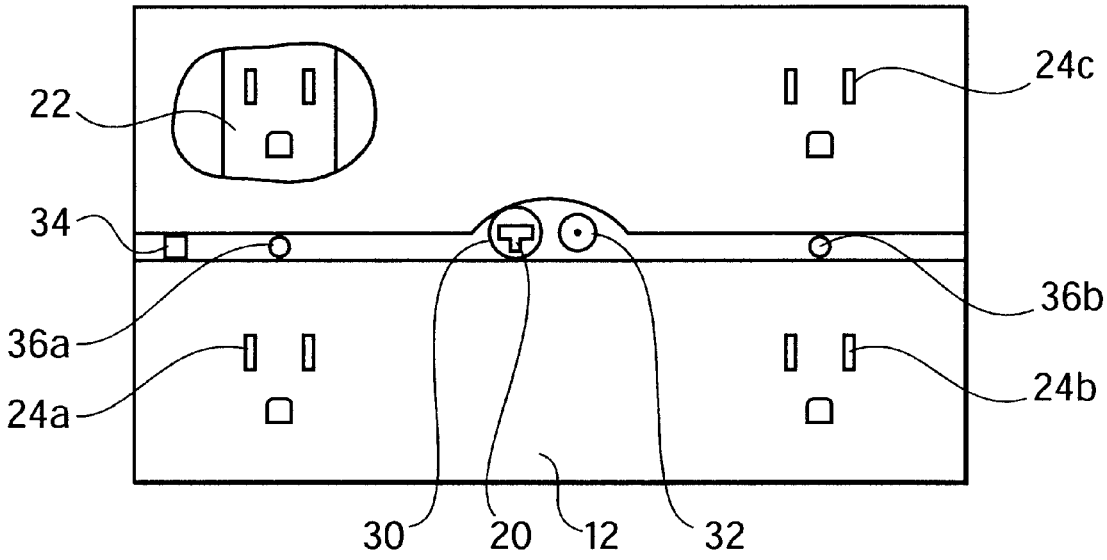
FIG. 2 is a front view of the cover plate according to an embodiment of the invention.
Figure 3:
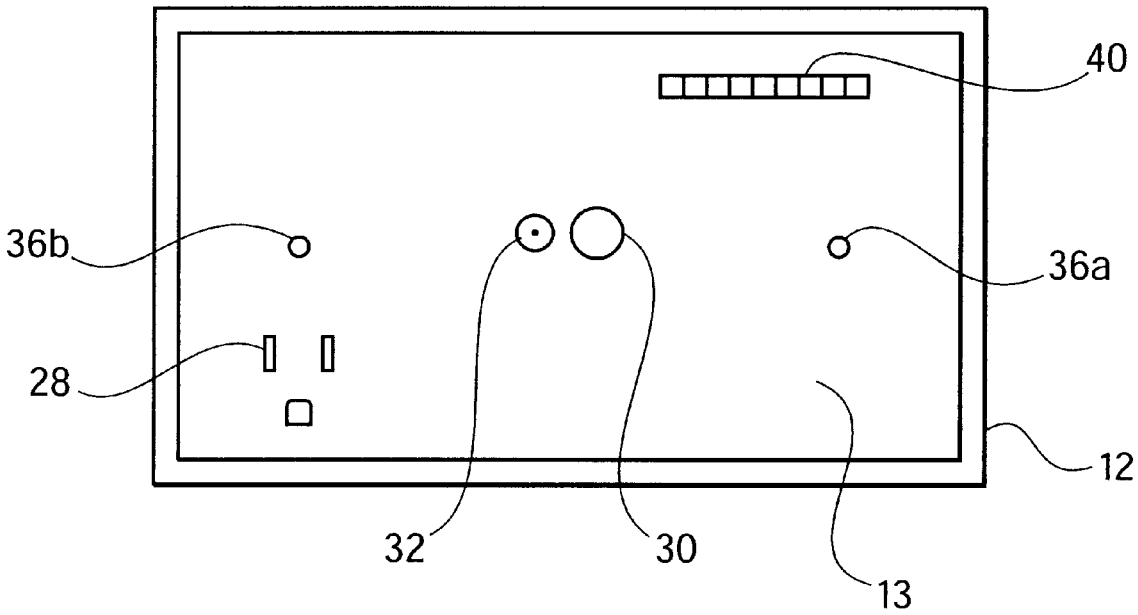
FIG. 3 is a rear view of the cover plate according to an embodiment of the invention.
Figure 4:
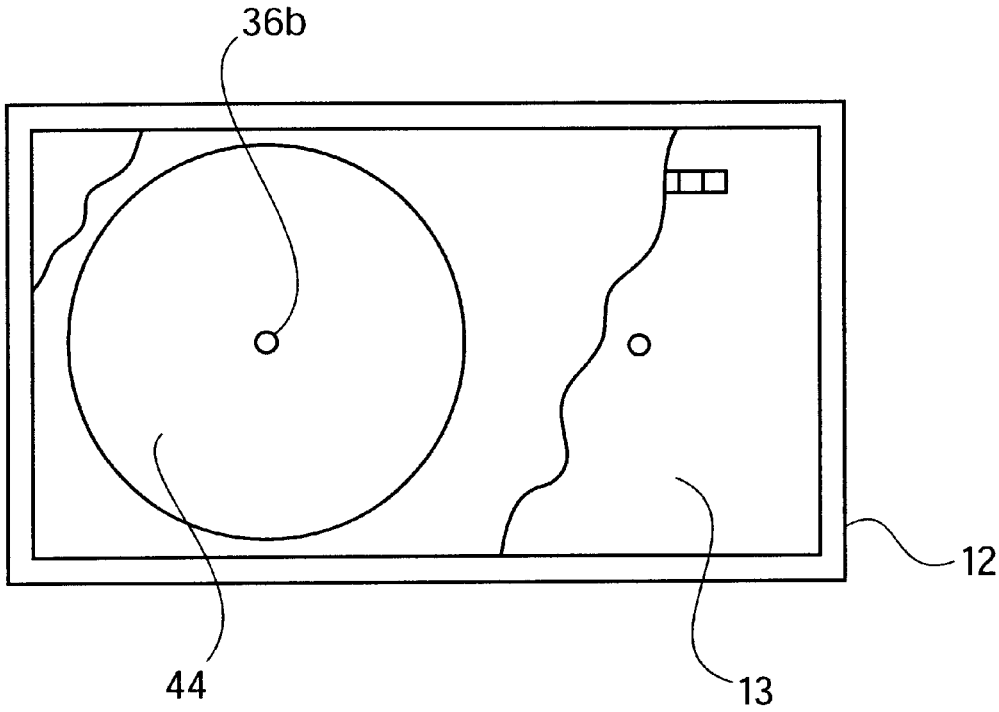
FIG. 4 is a partially broken away rear view of the cover plate according to an embodiment of the invention.
Figure 5:
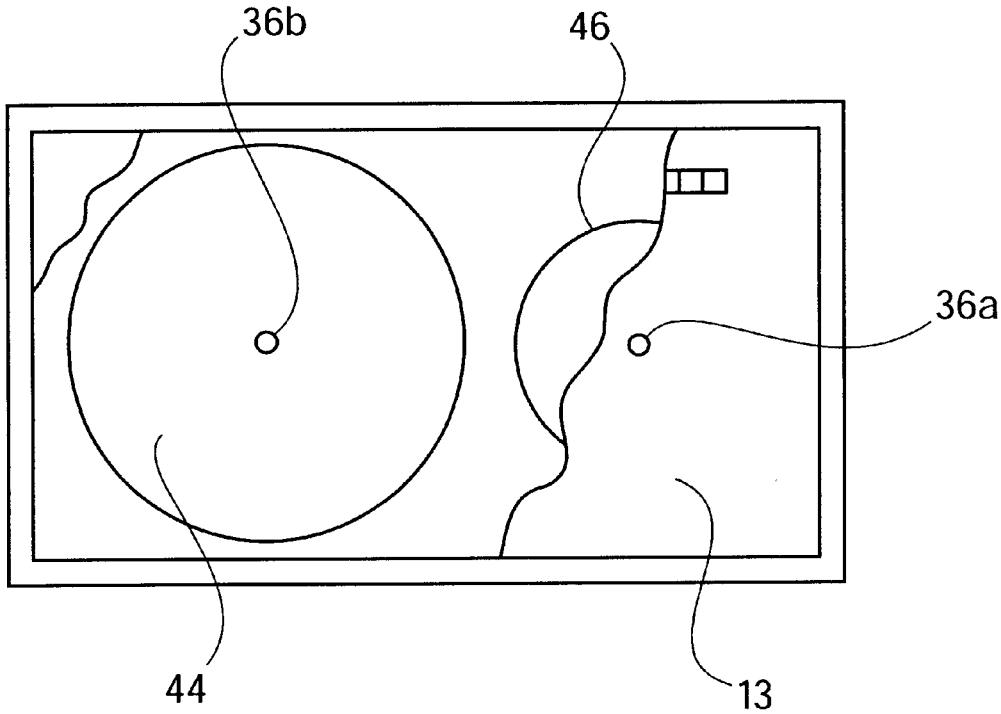
FIG. 5 is a partially broken away rear view of the cover plate according to another embodiment of the invention.

Cover plate 12 includes an outer decorative surface and an opposing in-wall engagement side 13 (FIGS. 2 and 3). On the outer decorative surface are several outlets 24*a*–24*c* and at least one extendable outlet 22. Outlet 22 is at the end of an internal cord-reel 44 contained within cover plate 12 (FIGS. 4 and 5). The manner in which cord-reels 44 and 46 are mounted and electrically connected to their sources can be found in U.S. Pat. Nos. 5,562,488 and 5,700,158, the entire contents of both are incorporated herein by reference. The cover plate 12 is a separate element that contains the cord-reel 44 for the outlet 22 and which is powered through the electrical connection of cover plate 12 to in-wall box 14.

On the in-wall engagement side 13, plug 28 is provided for electrical connection with receptacle 18 on in-wall box 14. Those of skill in the art will recognize that other methods for electrically connecting cover plate 12 to in-wall box 14 may be implemented without departing from the spirit of the invention. In one embodiment, in-wall box 14 includes a receptacle 18 that, when engaged with the plug 28 of cover plate 12, provides the cover plate and corresponding outlets 22 and 24*a*–24*c* and circuitry with power. In another contemplated embodiment, the power connection between in-wall box 14 and cover plate 12 can be made using a plurality of connectors 42 and receiving plugs 40. The connection using connectors 42 and plugs 40 can also-be adapted for providing telephone and/or data cable connections to the cover plate from the in-wall box 14 (discussed below). When cover plate 12 is disposed against the wall 16 and in electrical engagement with the in-wall box 14, mounting holes 37*a* and 37*b* are aligned with holes 38*a* and 38*b* in cover plate 12 and corresponding screws 38*a* and 38*b* are used to secure cover plates 12 in its operable position engages with in-wall box 14 and against wall 16.

Cover plate 12 can also includes surge protection and/or circuit breaker circuitry for one or more of the outlets 22 and 24*a*–24*c*. When circuit breaker circuitry is implemented for one or more outlets, a reset switch 26 is provided on the cover plate. Cover plates 12 is also equipped with an indicator light 34 or LED for providing a power indication and/or a circuit trip by the circuit breaker circuitry.

As mentioned previously, in-wall box 14 can also include a telephone cord reel 46 with a modular plug 20 that can be pulled through pass through hole 30 in the cover plate and provide up to ten (10) feet of telephone cord for the user. In accordance with another embodiment, telephone cord reel 46 can be disposed within cover plate 12 (FIG. 5). In this embodiment, the telephone connection to the in-wall box 14 can be made with a modular plug (not shown) on the engagement side 13 or using the aforementioned connectors 42 and plug 40.

Figure 6A:
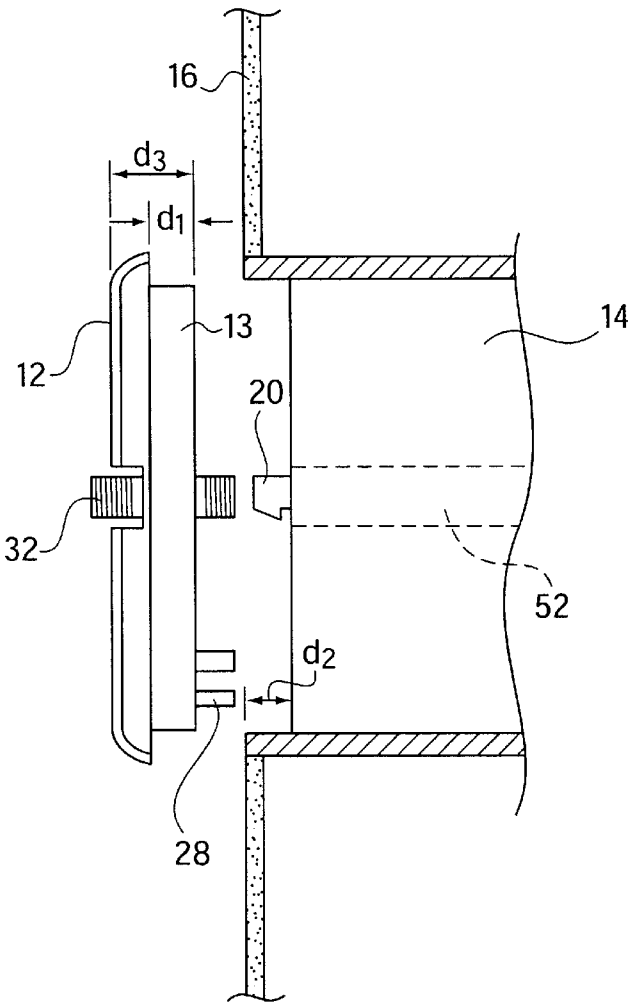
FIG. 6*a* is a partial cross-sectional view of the cord-reel assembly according to an embodiment of the invention.

Furthermore, a coaxial cable or television connection 32 is provided on cover plate 12. The coaxial connector 32 can simply pass through cover plate 12 and allow the connection of a wire on the engagement side 13 (FIG. 6*a*). In this configuration, a pass through hole 52 for the coaxial wire is provided in the in-wall box 42. In another embodiment, the coaxial connector 32 is mounted on in-wall box 14 and the pass through hole 30 in cover plate 12 allows access to both the telephone plug 20 and coaxial connector 32 when cover plate 12 is mounted in its operable positioned electrically engaged with the in-wall box.

Other contemplated embodiments replaces telephone cord-reel 46 with a data, fiber optic or any other suitable known type of wire for a particular communication application (e.g., Category 5, IEEE 1394 FireWire, etc.).

Figure 1B:
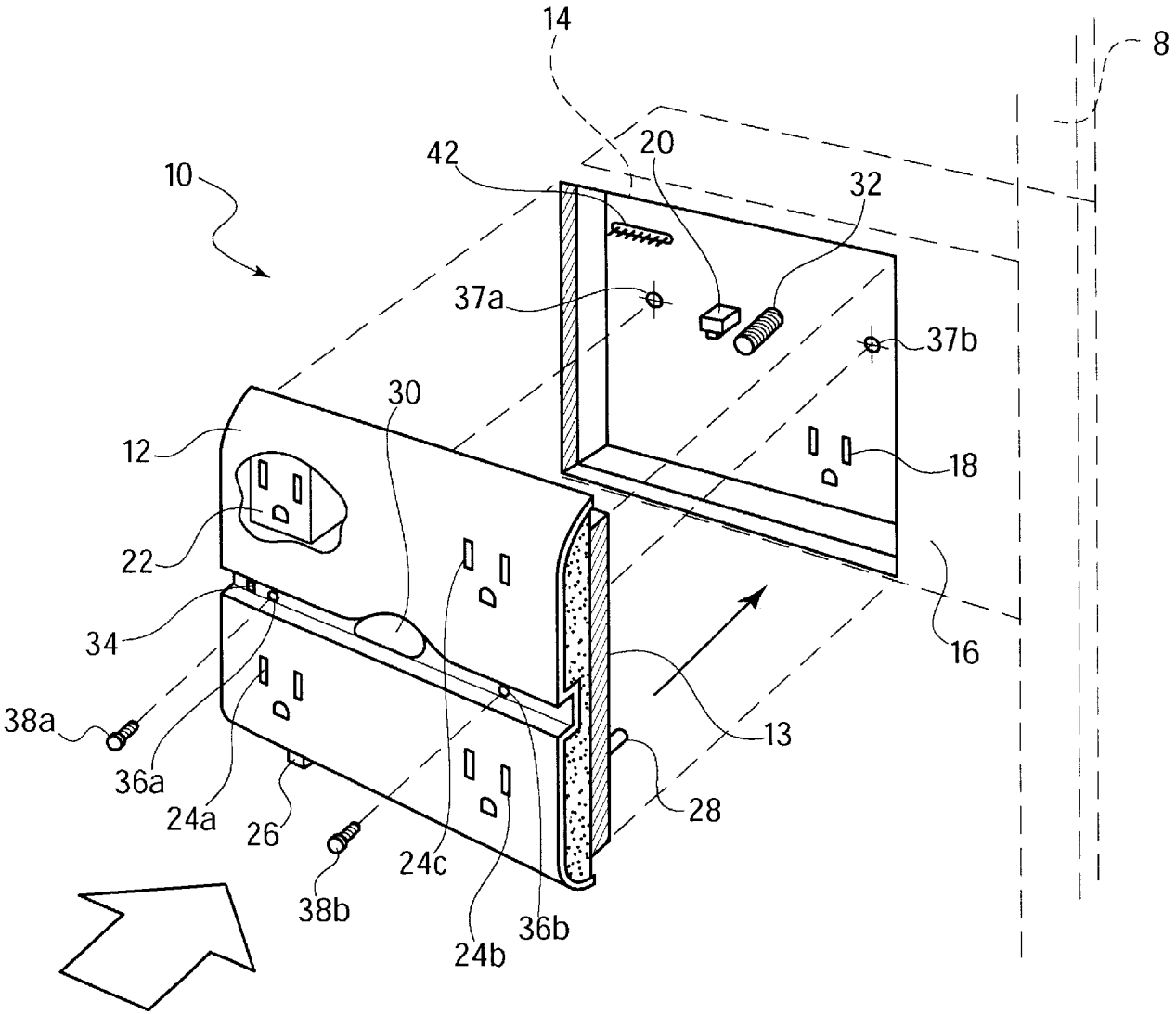
FIG. 1*b* is a perspective view of the cord-reel assembly according to another embodiment of the invention.
Figure 1C:
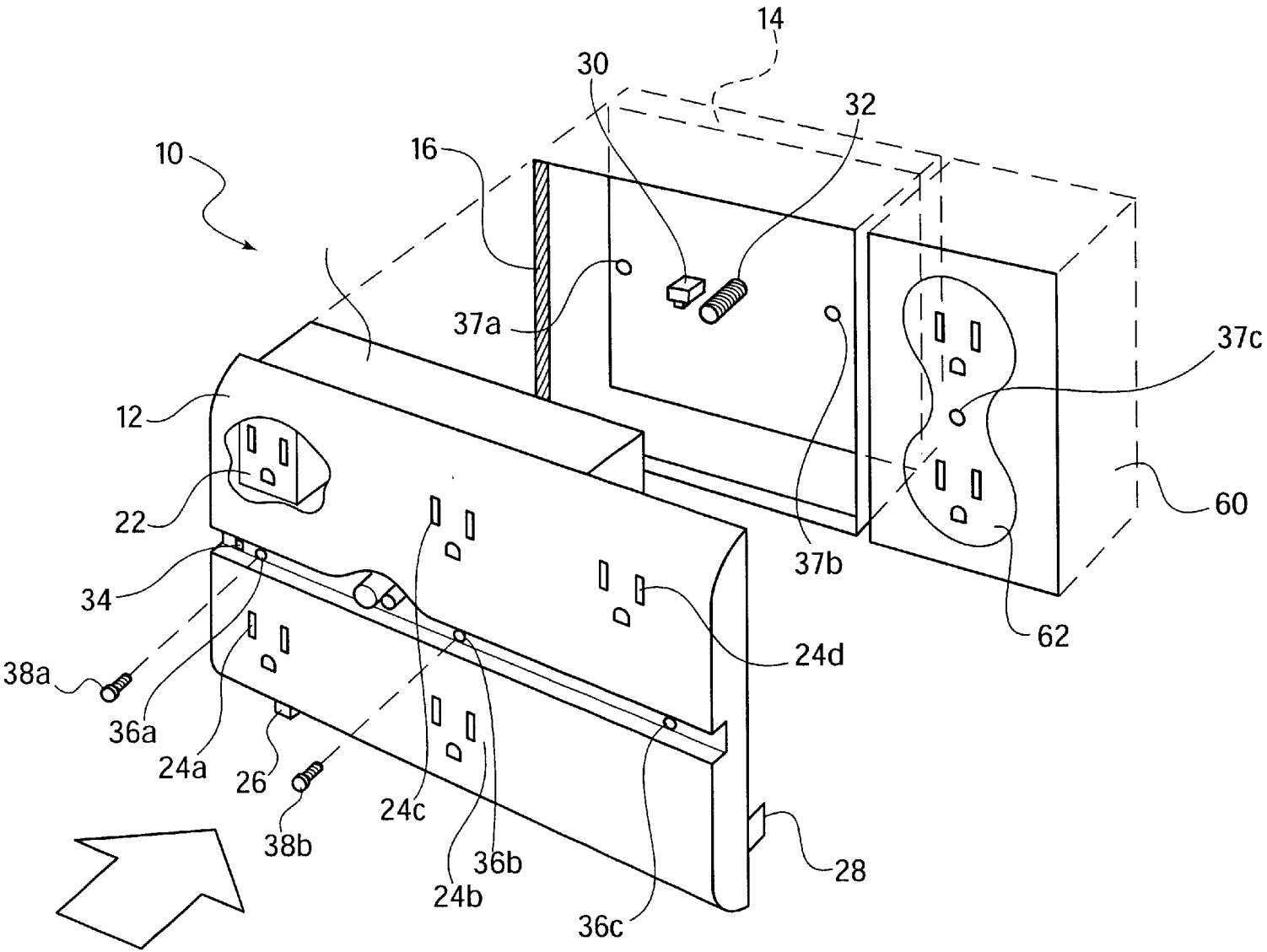
FIG. 1*c* is a perspective view of the cord-reel assembly according to another embodiment of the invention.

The aforementioned embodiments of FIGS. 1*a* and 1*b* are designed for new constructions environments. FIG. 1*c* shows an embodiment adapted for existing construction applications. As shown, cover plate 12 has been extended while engagement side 13 has remained the same. In this embodiment, a hole is made in wall 16 adjacent to an existing outlet box 60 having an outlet 62. The hole in the wall 16 accommodates the depth of engagement side 13 when plug 28 is received in outlet 62. According to one embodiment, the in-wall box 14 is not required, and all power for the cord-reel and outlets 24 in cover plate 12 is provided by the electrical connection of plug 28 with outlet 62. In another embodiment, in-wall assembly 14 can be mounted as shown to provide various features and additions to cover plate (as discussed with respect to FIGS. 1*a* and 1*b*). An additional mounting hole 36*c* is provided that aligns with the cover plate mounting hole 37*c* in outlet 62.

Referring to FIG. 6*a,* cover plate 12 has and overall depth (or thickness) $d_3$ and an engagement side 13 depth $d_1$. Those of skill in the art recognize that the overall depth $d_3$ is a matter of design choice and depends on the size of the internal reels 44 and/or 46. The engagement side depth $d_1$ can be any suitable amount provided in wall box 14 can be mounted and recessed from wall 16 such that depth $d_2$ is equal to depth $d_1$, such that cover plate 12 is flush against wall 16 when mounted in its operable engaged position with in-wall box 14. In an exemplary embodiment, depth $d_3$ is approximately 2"–2½" but may vary based on design considerations. The depth $d_2$ is determined by the recessed mounting of in-wall box 14 and is only limited by the actual depth of wall 16. For purposes of aesthetics, the portion of cover plate 12 that remains outside wall 16 is to be as low a profile as desired. For example, $d_3$–$d_1$ can equal ½.

There have shown and described and pointed out fundamental novel features of the invention as applied to preferred embodiments thereof, it will be understood that various omissions and substitutions and changes in the form and details of the methods described and devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A cord-reel assembly comprising:

an in-wall assembly connected to a source of electricity and having first electrical connection means, said in-wall assembly mounted within a wall in a recessed configuration having a predetermined depth; and a cover plate having a decorative side, an engagement side, at least one stationary outlet receptacle, a second electrical connection means on said engagement side to engage said first electrical connection means in said in-wall assembly, an internal cord-reel and at least one outlet receptacle connected to the end of the internal cord-reel and being accessible from said decorative side of said cover plate, said engagement side having a depth substantially equal to the predetermined depth of said in-wall assembly.

2. The cord-reel assembly according to claim 1, further comprising means for securing said cover plate in operative engagement with said in-wall assembly.

3. The cord-reel assembly according to claim 1, wherein said cord-reel and corresponding outlet receptacle and said at least one stationary outlet receptacle are powered when said second electrical connection means is engaged with said first electrical connection means.

4. The cord-reel assembly according to claim 2, wherein said securing means comprises at least one mounting hole in said in-wall assembly, at least one mounting hole in said cover plate adapted to be aligned with said in-wall mounting hole and at least one fastener for engaging said holes and securing said cover plate to said in-wall assembly.

5. The cord-reel assembly according to claim 1, wherein said in-wall assembly further comprises a telephone cord-reel and a modular plug at the end of said telephone cord-reel, said cover plate having an access hole for providing access to said modular plug when said cover plate is operably engaged with said in-wall box.

6. The cord-reel assembly according to claim 1, wherein said cover plate further comprises a telephone cord-reel and a modular telephone plug disposed on said decorative surface.

7. The cord-reel assembly according to claim 1, wherein said cover plate further comprises a coaxial cable connector, and said in-wall assembly further comprises a pass through for allowing a coaxial cable to be connected to said coaxial connector.

8. The cord-reel assembly according to claim 1, wherein said in-wall assembly further comprises a coaxial connector and said cover plate further comprises an access hole for allowing said coaxial connector to pass through said cover plate when operable engaged with and secured to said in-wall assembly.

9. The cord-reel assembly according to claim 1, wherein said cover plate further comprises circuit breaker protection circuitry for at least one of said outlet receptacles and a circuit breaker reset switch.

10. The cord-reel assembly according to claim 1, wherein said cover plate further comprises surge protection circuitry for at least one of said outlet receptacles.

11. An apparatus for electrically connected to a wall socket mounted within a wall and having an outlet, the apparatus comprising:

a cover plate having a decorative side, and engagement side, at least one stationary outlet accessible from said decorative side, connection means disposed on said engagement side for engaging the outlet in the wall socket, an internal cord-reel, at least one outlet receptacle connected to the end of the internal cord-reel having a modular telephone plug accessible from said decorative side, wherein said cover plate electrically connects said internal cord-reel to the wall socket outlet.

12. The apparatus according to claim 11, wherein said engagement side of said cover plate is recessed into the wall adjacent the wall socket when said second connection means engages the outlet in the wall socket.

13. The apparatus according to claim 12, further comprising an in-wall assembly disposed within the wall to align with said engagement side of said cover plate.

14. The apparatus according to claim 13, wherein said cover plate further comprises a coaxial cable connector, said in wall assembly further comprising a pass through for allowing a coaxial cable to be connected to said coaxial connector.

15. The apparatus according to claim 13, wherein said in-wall assembly further comprises a telephone cord-reel and a modular plug at the end of said telephone cord-reel, said cover plate having an access hole for providing access to said modular plug.

16. The apparatus according to claim 13, wherein said in-wall assembly is mounted within the wall in a recessed configuration, said recessed configuration having a predetermined depth, wherein said engagement side of said cover plate comprises a depth substantially equal to the predetermined recessed depth of said in-wall assembly.

17. The apparatus according to claim 11, wherein said cover plate further comprises circuit breaker protection circuitry for at least one of the outlet receptacles and a circuit breaker reset switch.

18. The apparatus according to claim 11, wherein said cover plate further comprises surge protection circuitry for at least one of said outlet receptacles.

19. A telephone cord-reel assembly comprising:

an in-wall assembly connected to a telephone line source and having a first telephone connection means, said in-wall assembly mounted within a wall in a recessed configuration having a predetermined depth; and a cover plate having a decorative side, an engagement side, second connection means disposed on said engagement side for engaging the first connection means, a telephone cord-reel and at least one telephone jack connected to the end of the telephone cord-reel, said engagement side having a depth substantially equal to the predetermined depth of said in-wall assembly.

* * * * *